United States Patent [19]

Francis

[11] 4,251,964

[45] Feb. 24, 1981

[54] GLAZING SYSTEM

[76] Inventor: Geoffrey V. Francis, 325 Welland Ave., St. Catharines, Ontario, Canada

[21] Appl. No.: 906,316

[22] Filed: May 16, 1978

[51] Int. Cl.[3] ..... E04B 1/00

[52] U.S. Cl. ..... 52/282; 52/235; 52/772

[58] Field of Search ..... 52/282, 235, 393, 395, 52/400, 459, 460, 461–472, 208, 398, 731, 764, 772

[56] References Cited

U.S. PATENT DOCUMENTS

| | | | |
|---|---|---|---|
| 1,893,956 | 1/1933 | Michaels | 52/282 |
| 1,999,219 | 4/1935 | Toney | 52/282 X |
| 2,917,793 | 12/1959 | Owen | 52/282 |
| 3,210,808 | 10/1965 | Creager | 52/282 |
| 3,221,453 | 12/1965 | Lietaert | 52/235 X |
| 3,766,698 | 10/1973 | Dallen | 52/235 |
| 3,866,374 | 2/1975 | Dallen | 52/235 X |
| 3,893,269 | 7/1975 | Nelsson et al. | 52/282 X |
| 4,024,680 | 5/1977 | Blyweert | 52/81 X |

FOREIGN PATENT DOCUMENTS

| | | | |
|---|---|---|---|
| 1509860 | 8/1969 | Fed. Rep. of Germany | 52/282 |
| 2158129 | 6/1973 | Fed. Rep. of Germany | 52/235 |

*Primary Examiner*—J. Karl Bell

*Attorney, Agent, or Firm*—Ridout & Maybee

[57] ABSTRACT

A glazing system is provided in which box section beams support glazing bars by means of a series of longitudinal flanges having undercuts which receive longitudinal flanges on the glazing bars. Some of the undercuts are arranged in arcs centered on further undercuts in adjacent flanges so that the angle between the bars and the beams, or between two glazing panels supported by a single beam, can be adjusted during assembly. The system is suitable both for roofs and for curtain walling.

3 Claims, 7 Drawing Figures

GLAZING SYSTEM

FIELD OF THE INVENTION

This invention relates to a glazing system for both roof glazing and vertical glazing, the same basic glazing bar and beam configurations being usable even though the angle between adjacent panels of glazing may vary widely.

Various proposals have been made for connecting adjacent panels of glazing or other structural panels at adjustable angles. Systems for this purpose are shown for example in U.S. Pat. Nos. 3,893,269 (Nelsson et al), 3,210,808 (Creager), 1,893,965 (Michaels), 4,024,680 1 (Blyweert) and 1,999,219 (Toney). In all these systems, the glazing bar mullion or other connecting member is essentially in the form of a continuous hinge, which permits adjustment of the angle between adjacent panels. The hinge construction means that the bar is made up of several parallel relatively movable members which can interact to lend each other strength only to the extent to which they can be locked together after erection; none of the constructions disclosed in the above patents appears adapted to act as a significant structural component in addition to its function of connecting adjacent panels. In practice, however, architectural design often requires that glazing bars are directly supported by structural members, as in curtain walls, and in any event they may be required to withstand considerable loads from the glazing panels themselves, particularly if these involve double glazing, such as mechanical double glazing or sealed double glazing units. Moreover, the support provided for the glazing panels should be as rigid as possible.

SUMMARY OF THE INVENTION

A primary object of the invention is to provide a glazing system which provides rigid support for glazing panels in a framework of considerable strength, but is at the same time adaptable to support glazing panels at a variety of different angles relative both to each other and to the framework members, and which is equally applicable to the glazing of both roofs and walls.

According to the invention, a glazing system comprises a longitudinally extending box section beam, a spaced pair of parallel longitudinally extending side flanges extending from one wall of the beam, the flanges having oppositely facing longitudinal undercuts, a third longitudinal centre flange parallel to and midway between said flanges, said third flange having longitudinal undercuts on both sides, one of said pair of side flanges and said centre flange having two series of parallel undercuts facing in opposite directions, each series of undercuts being arranged on an arc centred on an oppositely facing undercut in an adjacent flange, and at least one longitudinally extending glazing bar having flanges interlocked with two oppositely facing undercuts in two of said three flanges extending from the beam. By this means, the or each glazing bar is rigidly supported by the beam, which itself is rigid, yet the arcuate series of undercuts enable the angle of each glazing bar relative to the beam to be selected to suit the application. By using a small selection of different glazing bar sections, a very wide range of angles is possible between the glazing bars and the beam and between glazing bars supported by the same beam.

In a preferred arrangement, the series of undercuts are formed on opposite faces of the central flange and face inwardly facing undercuts in the side flanges. This facilitates the capture and drainage of condensation.

Usually, a glazing system will require both longitudinal and lateral members. In a preferred arrangement, the beams used for the longitudinal and lateral members are of similar section except for that wall from which the flanges extend, which wall is a different distance from the opposite side of the section, so that when the beams are mortised together, portions of those walls can be made to overlap enabling them to be bolted together.

Further features of the invention will be apparent from the following description of preferred embodiments thereof with reference to the accompanying drawings.

SHORT DESCRIPTION OF THE DRAWINGS

DESCRIPTION OF THE PREFERRED EMBODIMENTS

Figure 1:
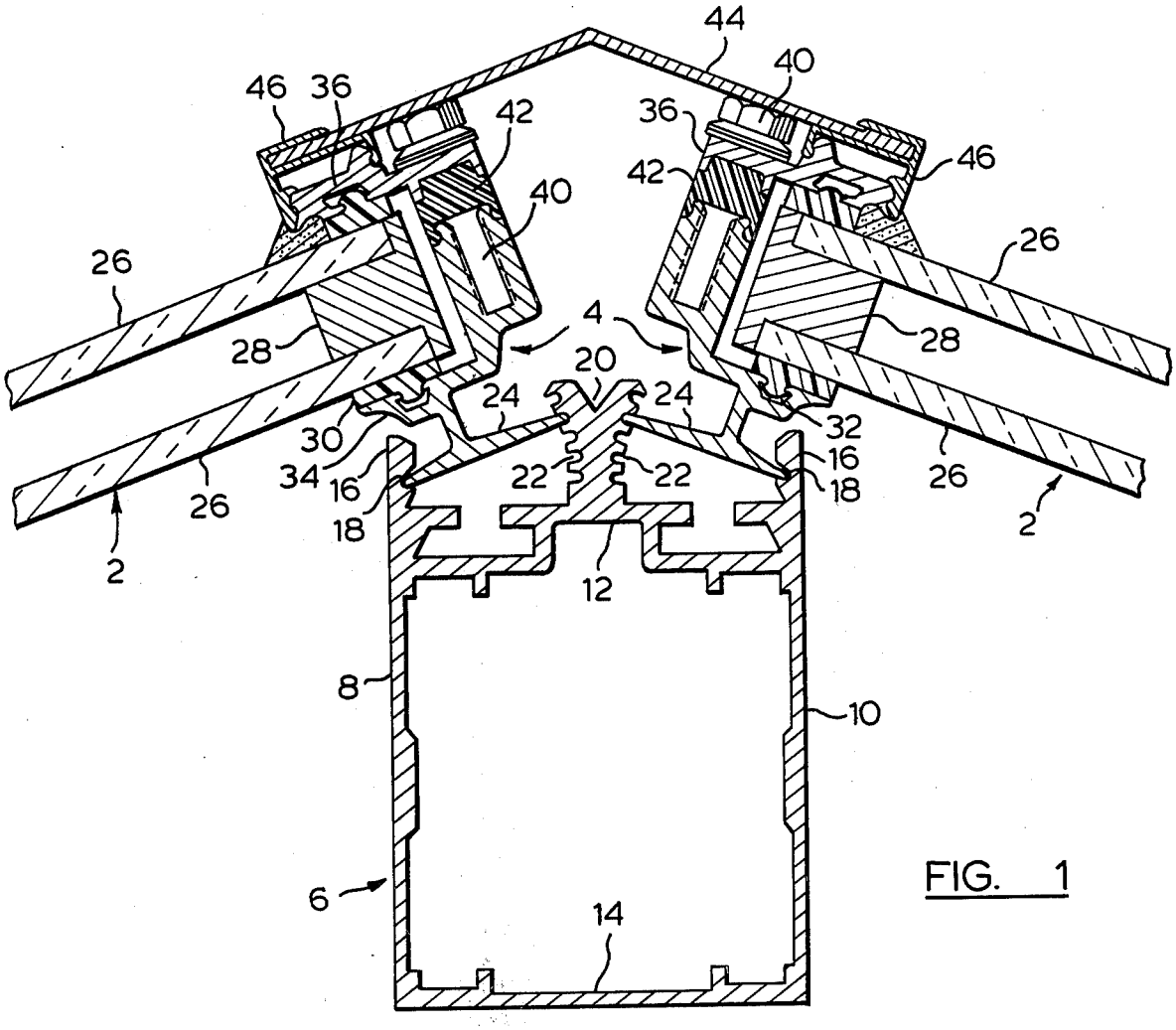
FIG. 1 shows a fragmentary vertical cross-section through the ridge or hip of a roof utilizing a glazing system in accordance with the invention.

Referring to FIG. 1, a ridge or hip portion of a glazed roof is shown, with double glazing units 2 carried by glazing bars 4 rigidly supported on a beam 6.

Figure 2A:
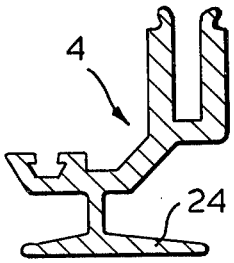
FIGS. 2A–2D show alternative forms of glazing bar for use in conjunction with the support beam shown in FIG. 1.
Figure 2D:
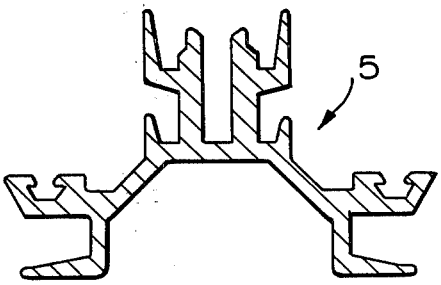
Figure 2B:
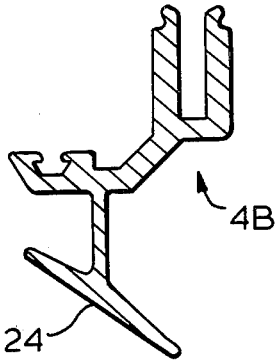
Figure 2C:
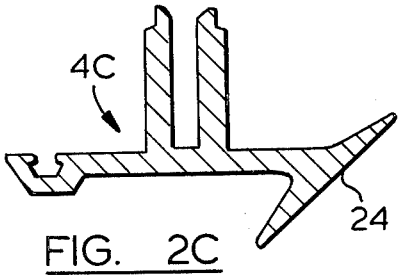

The beam 6 is an aluminum extrusion of box section having side walls 8 and 10, and top and bottom walls 12 and 14. The side walls 8 and 10 have upward extensions forming longitudinal flanges 16, the inside faces of which are formed with undercuts 18. A central longitudinal web 20 also projects upwardly from the top wall 12, and this web has on each side a series of parallel undercuts 22, these series of undercuts being arranged on arcs centred on the undercuts 18. The glazing bars 4 have broad feet 24, opposite flanges of each of which engage respectively one of the undercuts 18 and one of one of the series of undercuts 22 so as to lock the bars at predetermined angles to the beam 6. By the use of different undercuts 22 in the series, the magnitude of the predetermined angle may be incrementally varied, typically in 6° steps. A much extended range of angles is obtainable by utilizing glazing bars having feet 24 set at different angles to the remainder of the bar. Thus the bar configuration utilized in the assembly of FIG. 1 is shown in FIG. 2A, alternative forms of glazing bar 4 which extend the range of angles possible between the bar 4 and the beam 6 being shown in FIGS. 2B and 2C.

The double glazing units 2, each of which comprise inner and outer panes of glass 26 and a spacer 28, rest on gaskets 30 retained by recesses 32 in glazing nibs 34 of the glazing bars 4, and are clamped in place by caps 36 acting on the units through gaskets 38, the caps being secured by screws 40 passing through heat insulating thermal barrier strips 42 into channels defined by the glazing bars 4. A ridge plate 44 is held in place by continuous extruded clips 46 engaging the caps 36. According to the angle of the ridge, the same clips 46 may be used with alternative ridge plates.

Figure 3:
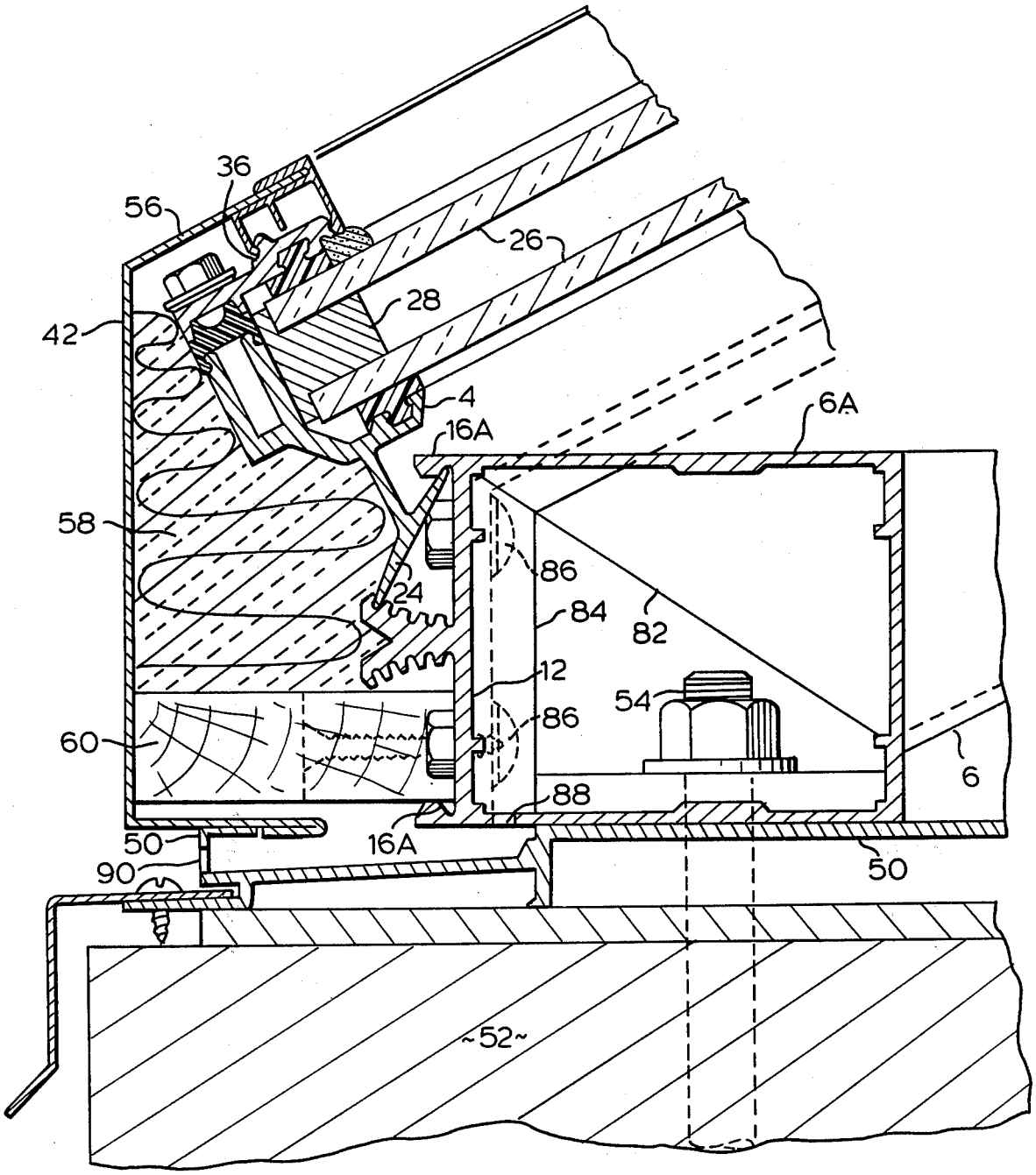
FIG. 3 shows a fragmentary vertical cross-section through the eave of a roof.

Referring now to FIG. 3, the use of the system at an eave of a roof is illustrated. The beam 6A is similar to that shown in FIG. 1, apart from differences in the top wall 12 which are discussed later. Since only one glazing unit is being supported, only a single glazing bar 4B is utilized, this being of the type shown in FIG. 2B so as to obtain the required angle between the glazing unit and the beam. The ridge plate of FIG. 1 is replaced by a fascia plate 56 which clips to the capping member 36 and the wall plate 50. The fascia plate is filled with insulation 58 and maintained in position by a wooden spacer 60.

Figure 4:
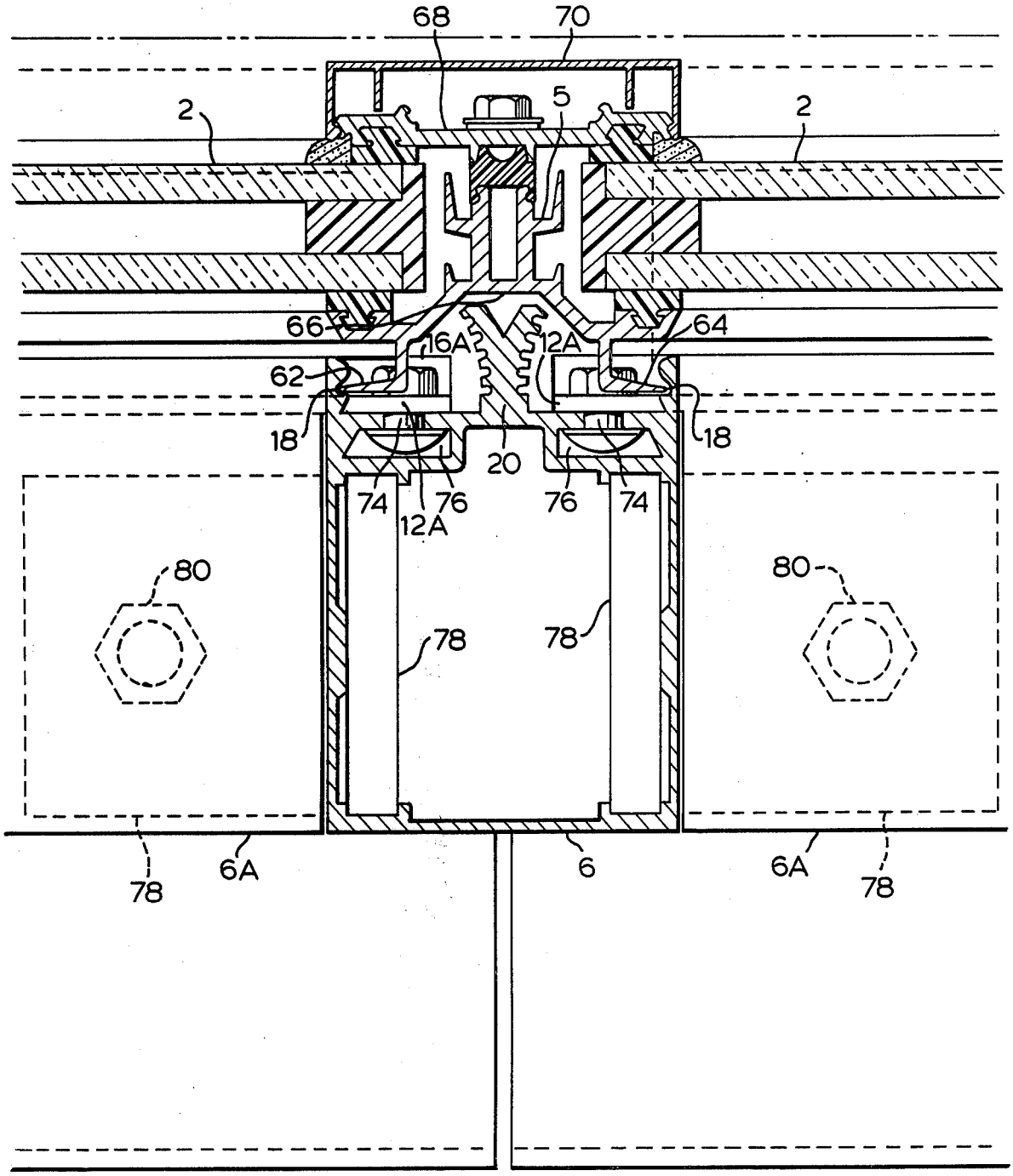
FIG. 4 shows a fragmentary horizontal cross-section through a portion of a curtain wall.

Referring to FIG. 4, this shows a section through a mullion of a glazed curtain wall or roof horizontal bar. The beam 6 is the same as that shown in FIG. 1, but since the glazing units 2 lie in a common plane, it is possible to use, instead of two separate glazing bars 4 of the section shown in FIG. 2A, a single glazing bar 5 of the section shown in FIG. 2D. This has two spaced feet 62 and 64 which engage the undercuts 18 whilst an intermediate web 66 straddles the web 20. A common cap 68 serves to secure both glazing units and is provided with a clip-on cover 70.

The transoms of the wall are formed of further beams 6A of similar cross-section to the beam 6A shown in FIG. 3. The ends of the beams 6A are cut away except for the projecting portions of the top wall 12A and the flanges 16A, whilst cut-outs are formed in the flanges 16 of the beam to accommodate the projecting portions of the walls 12A of the beams 6A. The top walls 12A are secured to the top wall 12 by bolts 74 the heads of which are retained by dove-tail recesses 76 in the wall 12. The members 6 may be secured to a supporting structure, by means of angle lugs 78 which interlock with projections within the beam 6 and are secured to the support structure by bolts 80.

By using the two beam sections 6 and 6A for longitudinal and cross members respectively an entire wall or roof framework can be built up. Angled joints may be accommodated as can be seen by further reference to FIG. 3, in which a recess is cut in the beam 6A, so as to accommodate the end of a sloping beam 6, the end 82 of which is cut through at an angle except for a projecting portion 84 of the wall 12, which is bent down at an angle so that it can be secured to the wall 12A by means of bolts 86, the heads of which are retained in the dove-tail recesses of the wall 12. These recesses also act as condensation channels which trap condensation running off the glazing bars 4 and allow it to escape from the roof through weep holes 88 and 90.

Although the series of multiple undercuts 22 are shown formed on opposite sides of the flange or web 20, they could be formed instead on the flanges 16 if these were appropriately reproportioned; however the arrangement shown is preferred.

What I claim is:

1. A glazing system comprising a longitudinally extending box section beam, a spaced pair of parallel longitudinally extending side flanges extending from one wall of the beam, each of the flanges having an inwardly facing longitudinal undercut, a third longitudinal centre flange parallel to and midway between said flanges, said third flange having longitudinal undercuts on both sides, facing in opposite directions, the undercuts on each side being arranged on a circular arc centred on the oppositely facing undercut in a side flange and at different angles to said one wall, and at least one longitudinally extending glazing bar having flanges selectively engageable with oppositely facing undercuts in said centre flange and one of said side flanges.

2. A glazing system according to claim 1 having both longitudinal and lateral members, wherein the beams used for the longitudinal and lateral members are of similar section except for that wall from which the flanges extend, which wall is a different distance from the opposite side of the section, so that when the beams are mortised together, portions of those walls can overlap enabling them to be bolted together.

3. A glazing system according to claim 1, wherein at least one glazing cap is secured to said glazing bar to retain the edge of a glazing unit against a glazing nib on the glazing bar, a continuous clip member adapted to be sprung onto said glazing cap for holding one edge of a cover member.

* * * * *